United States Patent [19]

Kashiwaya et al.

[11] Patent Number: 4,475,518

[45] Date of Patent: Oct. 9, 1984

[54] FUEL INJECTION APPARATUS FOR INTERNAL COMBUSTION ENGINES

[75] Inventors: Mineo Kashiwaya; Yoshiyuki Tanabe; Kinsaku Yamada, all of Katsuta; Hisato Tsuruta, Hitachi, all of Japan

[73] Assignee: Hitachi, Ltd., Tokyo, Japan

[21] Appl. No.: 445,940

[22] Filed: Dec. 1, 1982

[30] Foreign Application Priority Data

Dec. 2, 1981 [JP] Japan ..... 56-192861

[51] Int. Cl.[3] ..... F02M 51/00

[52] U.S. Cl. ..... 123/494; 123/339; 73/118

[58] Field of Search ..... 123/339, 494, 585, 587, 123/588; 73/118, 118 A

[56] References Cited

U.S. PATENT DOCUMENTS

| | | | |
|---|---|---|---|
| 4,264,961 | 4/1981 | Nishimura et al. | 123/494 |
| 4,366,704 | 1/1983 | Sato et al. | 73/118 A |
| 4,385,602 | 5/1983 | Itou et al. | 123/339 |
| 4,400,974 | 8/1983 | Nishimura et al. | 73/118 A |
| 4,404,846 | 9/1983 | Yamauchi et al. | 123/494 |
| 4,407,248 | 10/1983 | Takeuchi et al. | 123/494 |
| 4,417,558 | 11/1983 | Osuga et al. | 123/494 |

*Primary Examiner*—Parshotam S. Lall

*Attorney, Agent, or Firm*—Antonelli, Terry & Wands

[57] ABSTRACT

In a fuel injection apparatus for internal combustion engine wherein a hot wire sensor is provided in an air bypass communicating the upstream side of a Venturi portion formed in an air-intake path with the Venturi portion, the amount of air flowing in the air bypass is controlled by an air-scaling valve driven by an electromagnetic device so that the output of the hot wire sensor converges to a set level, fuel is scaled by a fuel-scaling valve driven by the electromagnetic device in accordance with the change of the amount of air supplied to the engine, and the scaled fuel is continuously injected into the air-intake path, the set level is determined to a value which is smaller than a maximum output value of the hot wire sensor occurring when the air-scaling valve is fully opened during idling operation of the engine, thereby ensuring that the output of the hot wire sensor can converge to the set level during the idling operation.

5 Claims, 4 Drawing Figures

FUEL INJECTION APPARATUS FOR INTERNAL COMBUSTION ENGINES

This invention relates to fuel injection apparatus for internal combustion engines, and particularly to a fuel injection apparatus for internal combustion engines which is capable of feeding fuel from a single fuel injection portion to all cylinders of an internal combustion engine.

In general, there is known a fuel injection apparatus for internal combustion engine which feeds fuel from a single fuel injection portion to all cylinders of an internal combustion engine.

This known fuel injection apparatus for internal combustion engine is constructed as follows. A throttle valve is provided in an air-intake path connected to the upstream side of an air-intake tube meeting portion communicating with each cylinder, and a fuel injection portion is provided on the upstream side of this throttle valve. Also, an electromagnetic valve forming the fuel injection portion is driven by a pulse with a certain width to intermittently inject fuel into the air-intake path. This valve opening pulse is controlled in its width by an air-intake amount signal which is detected by an air flow meter provided in the air-intake path.

This known fuel injection apparatus has the following drawbacks:

(1) Since the fuel injection portion intermittently injects fuel into the air-intake path connected to the upstream side of the air-intake tube meeting portion, thick and thin air-fuel mixture portions are alternately formed between the air-intake path and the air-intake tube meeting portion, that is, the air-fuel mixture becomes non-uniform in space. Thus, when the cylinders of the internal combustion engine sequentially intake the air-fuel mixture, some cylinders intake a thick mixture and another one does a thin mixture, that is, the distribution property of fuel is poor. This causes variation of torque in the internal combustion engine.

(2) Since the air flow meter is used to measure the amount of air intake and determine the valve opening pulse width over a wide range from idling drive to high-speed, high load drive, the precision of the air flow meter is required over the wide range. In other words, the air flow meter must practically detect the true amount of air taken in the internal combustion engine over the wide range from idling drive to high-speed, high load drive. This requires a high-precision air flow meter over a wide range and causes a signal processing circuit connected to the output of the air flow meter to be complicated in construction.

The applicant of this application has proposed an approach to these problems as disclosed in U.S. patent application Ser. No. 333,296 entitled "Fuel Injection Apparatus for Internal Combustion Engine" and filed on Dec. 22, 1981, now U.S. Pat. No. 4,442,818.

According to this proposal, an air flow sensor is provided in an air bypass through which the upstream side of a Venturi portion formed in an air-intake path communicates with the Venturi portion, the amount of air passing through the air bypass is controlled by an air-scaling valve driven by an electromagnetic device so that the output of the air flow sensor converges to a set level, and at the same time fuel is scaled by a fuel-scaling valve also driven by the electromagnetic device in accordance with changes in the amount of intake air to the engine and injected into the air-intake path in the form of a continuous flow.

This construction is advantageous in that because of the continuous supply of fuel, the mixture becomes uniform and the signal of the air flow sensor is simply required to be above or below the set level so that the air flow sensor is not required to have a high precision.

In execution of the feedback control as above wherein the output of the air flow sensor is compared with the set level to make the output of the air flow sensor converge to the set level, however, determination of the set level plays an important role and the value of the set level cannot be decided at will.

More particularly, when the set level has a relatively large value, the controller may simply operate to restrict the degree of opening of the air-scaling valve in response to a signal produced from the air flow sensor which is larger than the set level so as to decrease the output of the air flow sensor, and this operation may continue until the air-scaling valve is fully closed.

With a smaller output signal of the air flow sensor than the set level, on the other hand, the controller may operate to increase the degree of opening of the air-scaling valve to thereby bring the output of the air flow sensor to the set level but the output of the air flows sensor will fail to reach the set level even with the air-scaling valve fully opened in a case of idling operation wherein the amount of air is minimum.

Then, consider the relation between the maximum output of the air flow sensor and the set level over the range of engine operation of from idling operation to high speed operation under a condition that the air-scaling valve is fully open to permit air to freely pass through the air bypass. If the maximum output of the air flow sensor occuring during the idling operation is smaller than the set level, in other words, the set level exceeds the maximum output of the air flow sensor during the idling operation, in spite of the fact that the controller produces an output which acts to open the air-scaling valve so as to make the output of the air flow sensor converge to the set level, it will be impossible to increase the amount of air passing through the air bypass for bringing the output of the air flow sensor in convergence toward the set level since the air-scaling valve has already reached its full opening, thus resulting in failure of the feedback operation during the idling operation.

It is an object of this invention to provide a fuel injection apparatus for internal combustion engine having a set level which can make the output of an air flow sensor converge to a set level even during idling operation.

According to this invention, the set level is made smaller than an output of the air flow sensor corresponding to an amount of air passing through an air bypass which occurs when an air-scaling valve is fully opened during the idlng operation to thereby ensure that the output of the air flow sensor can be converged to the set level even during the idling operation.

The present invention will be apparent from the following detailed description taken in conjunction with the accompanying drawings, in which.

Prior to describing the invention by way of example, construction and operation of a fuel injection apparatus for internal combustion engine to which the invention is applied will first be described with reference to FIG. 1.

Figure 1:
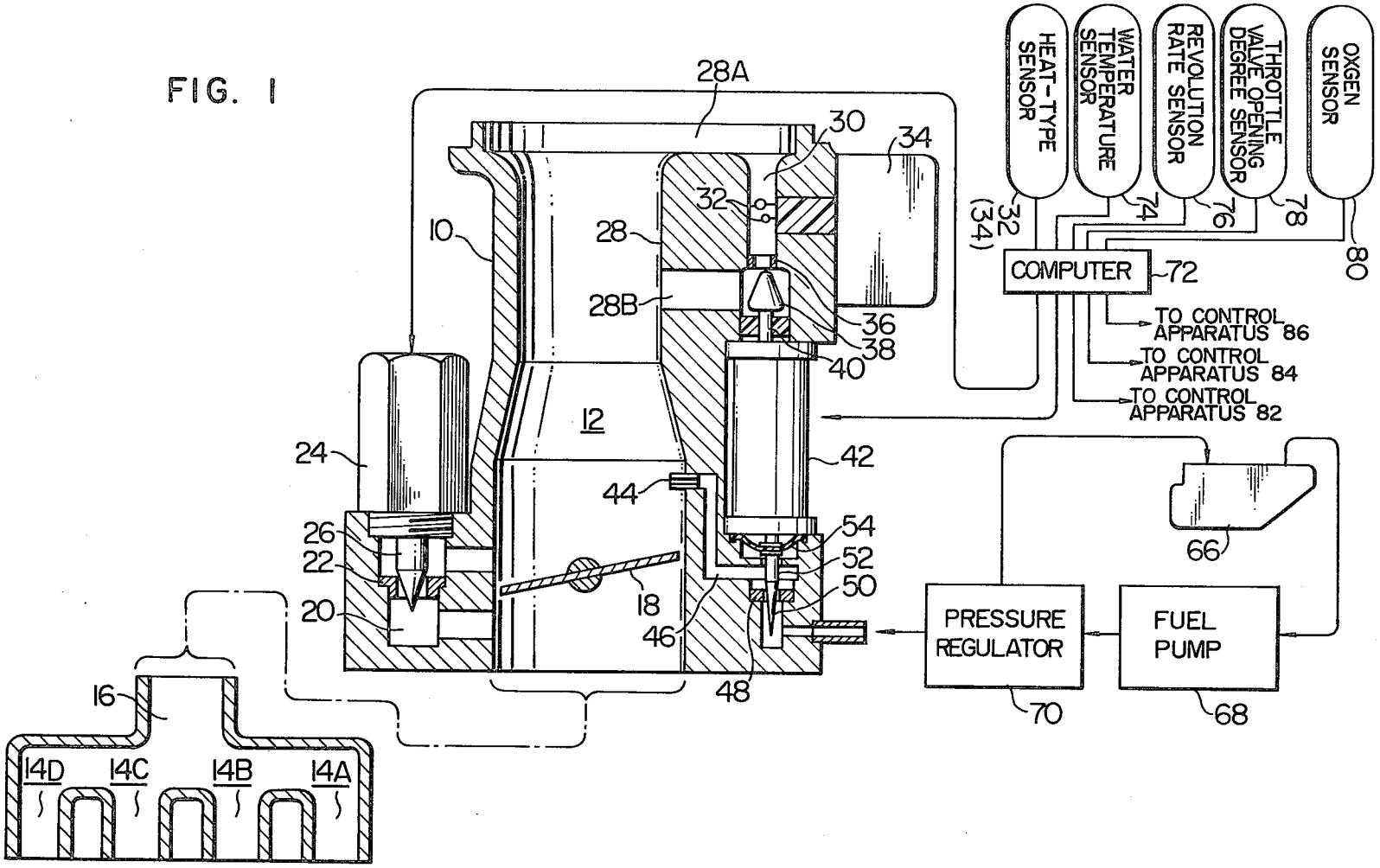
FIG. 1 is a schematic diagram of a fuel injection apparatus for internal combustion engine to which the invention is applicable.

In FIG. 1, there is shown a main body 10 in which an air-intake path 12 is formed. The air-intake path 12 is connected to a meeting portion 16 at which are met air-intake tubes 14A, 14B, 14C and 14D communicating with the respective cylinders of an internal combustion engine. A throttle valve 18 is rotatably mounted in the air-intake path 12 formed in the main body 10, and it is operated by an accelerqation pedal. The air-intake path portions on the upper and lower sides of the throttle valve 18 are connected by a correction air-intake path 20 as a bypass. At a middle of this correction air-intake path 20 there is provided an orifice 22, which constitutes a scale together with a valve 26 which can be driven by an electromagnetic device 24. A Venturi portion 28 is formed in the air-intake path 12 on the upper side of the throttle valve 18 and it has an inlet portion 28A and a narrowest portion 28B which are connected by a bypass 30 formed in the body 10. At a middle of the bypass 30 is provided a heat-type flow sensor 32 such as a hot wire sensor, hot film sensor or Thomas meter. A signal from the heat-type flow sensor 32 is processed by a signal processing circuit 34 which is fixedly mounted on the main body 10. An air-scaling orifice 36 is provided in the bypass 30 on the lower side of the heat-type sensor 32 to make an air-scaling portion together with a tapered air-scaling valve 38, which is connected to a proportion electromagnetic device 42 via an output shaft 40.

Figure 2:
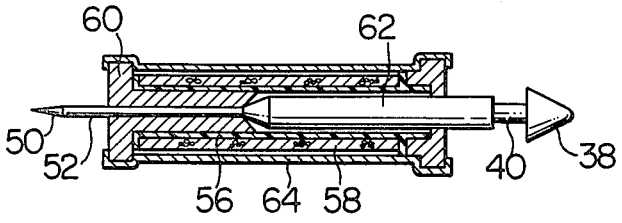
FIG. 2 is a longitudinal sectional view showing the construction of a proportion electromagnetic device, an air-scaling valve and a fuel-scaling valve.

On the other hand, a fuel injection portion 44 is provided between the throttle valve 18 and the Venturi portion 28 so as to communicate with a fuel path 46 formed in the main body 10. A fuel-scaling orifice 48 is provided in the fuel path 46 at a certain position and forms a fuel-scaling portion together with a tapered fuel-scaling valve 50, which is connected through an output shaft 52 to the proportion electromagnetic device 42. The output shaft 52 and the main body 10 are partitioned by a bellow type diaphragm 54 so that the fuel in the fuel path 46 does not leak out of the main body 10. The air-scaling valve 38, fuel-scaling valve 50 and proportion electromagnetic device 42 are constructed as shown in FIG. 2. In FIG. 2, the proportion electromagnetic device 42 is formed of a coil 58 wound on a hollow bobbin 56, a fixed core 60 inserted and fixed in the hollow of the bobbin 56, a movable core 62 slidably disposed in the hollow of the bobbin 56, a casing 64 and so on. The movable core 62 has one end fixed to the output shaft 40 and the other end fixed to the output shaft 52. Thus, the air-scaling valve 38, fuel-scaling valve 50 and movable core 62 are connected in line so that the air-scaling valve 38 and fuel-scaling valve 50 are simultaneously driven by the movable core 62.

The fuel from a fuel tank 66 is compressed by a fuel pump 68, regulated by a pressure regulator 70 and then fed to the fuel path 46. In this case, the pressure regulator 70 and fuel pump 68 used are known, and the pressure regulator 70 is constructed to provide a pressure of 0.7 kg/cm$^2$ to fuel.

The relation between input and output signals of a computer 72 will hereinafter be described.

The computer 72 is supplied at its input with signals from the heat-type sensor 32 (equivalently from the signal processing circuit 34), a water temperature sensor 74 for detecting the temperature of the cooling water for engine, a revolution rate sensor 76 for detecting the number of revolutions of engine, a throttle valve opening degree sensor 78 for detecting the degree of opening of the throttle valve 18, and an oxygen sensor 80 provided in the exhaust tube. Other engine operation parameters for various corrections may obviously be applied to the computer 72.

On the other hand, the outputs of the computer 72 are fed to the electromagnetic device 24, proportion electromagnetic device 42, an EGR (exhaust gas recycle) control apparatus 82, an ignition timing control apparatus 84, and a control apparatus 86 for the fuel pump 68.

The above devices and apparatus other than the electromagnetic device 24 and the proportion electromagnetic device 42 will not be described because they are not concerned with this invention.

Figure 3:
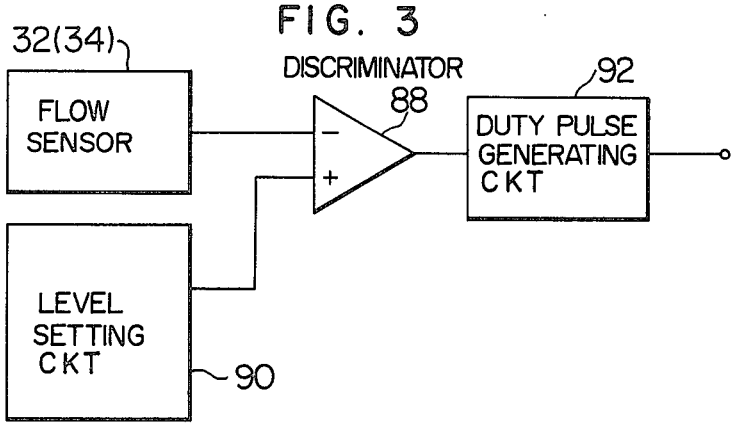
FIG. 3 is a block diagram of a control circuit for generating a control signal applied to the proportional electromagnetic device.

The signal fed to the proportion electromagnetic device 42 is a duty pulse signal the duration of which is controlled, and this duty pulse signal is formed by a circuit shown in FIG. 3, which is a part of the computer 72. A discriminator 88 comprised of a differential amplifier has its inverting input terminal to which is applied a signal from the heat-type flow sensor 32, and its non-inverting input terminal to which is applied a level signal from a level setting circuit 90. A comparison signal from the discriminator 88 is fed to a duty pulse generating circuit 92 at the following stage, where it is converted to a duty pulse which is then fed to the proportion electromagnetic device 42.

In this case, the level setting circuit 90 can change the reference level in accordance with the operating condition of the engine, for example, with the signals from the water temperature sensor 74, revolution rate sensor 76, throttle valve open sensor 78, oxygen sensor 80, and so on.

The operation of the above mentioned arrangement will be described.

When the engine is operated now, air is passed through the air-intake path 12, causing a pressure difference between the inlet portion 28A and narrowest portion 28B of the Venturi portion 28 as a result of a Venturi negative pressure produced at the narrowest portion 28B.

Accordingly, air is passed from the inlet portion 28A of the Venturi portion 28 via the bypass 30 to the narrowest portion 28B of the Venturi portion 28. This air flow is detected by the heat-type flow sensor 32, the signal H/W from which, as shown in FIG. 3, is compared with the setting level $R_{ef}$ at the discriminator 88. Thus, the throttle valve 18 is closed to reduce the amount of air to be supplied to the engine, so that the negative pressure at the Venturi portion 28 is decreased. Consequently, the value of the signal H/W from the sensor 32 becomes lower than the setting level $R_{ef}$ because low Venturi negative pressure decreases the air flow in the bypass 30. The discriminator 88 supplies a component which increases the amount of air passing through the bypass 30 to the duty pulse generating circuit 92. As a result, the computer 72 including the duty pulse generating circuit 92 supplies the duty pulse to the proportion electromagnetic device 42 thereby pushing the air-scaling valve 38 downward in FIG. 1 so that the amount of air flow in the air-scaling portion which amount is determined by the air-scaling valve 38 and air-scaling orifice 36 reaches the setting level $R_{ef}$. At this time, since the moving core 62 of the proportion electromagnetic device 42 causes the fuel-scaling valve 50 to move in the same direction as does the air-scaling valve 38, the fuel flow in the fuel-scaling portion which is determined by the fuel-scaling valve 50 and fuel-scaling orifice 48 is naturally decreased with the decrease of air flow to the engine. The fuel passing the fuel-scaling valve 50 is injected into the air-intake path 12 from the fuel injection portion 44. The fuel injection flow from the fuel injection portion 44 is continuous. Of course, the shape of the fuel-scaling valve 50 must be determined so that the air/fuel ratio at this time approaches a target value, for example, a theoretical air/fuel ratio.

Then, when the air flow to the engine through the throttle valve 18 is increased, the Venturi negative pressure at the Venturi portion 28 increases and as a result much air is passed through the bypass 30. Thus, the signal H/W from the heat-type flow sensor 32 becomes higher than the setting level $R_{ef}$. The discriminator 88 supplies a component which decreases the amount of air passing through the bypass 30 to the duty pulse generating circuit 92. The computer 72 thus supplies the duty pulse to the proportion electromagnetic device 42 which then drives the air-scaling valve 38 to move upward in FIG. 1 so that the amount of air flow passing through the air-scaling portion which amount is determined by the air-scaling valve 38 and air-scaling orifice 36 reaches the setting level $R_{ef}$. At this time, since the movable core 62 of the proportion electromagnetic device 42 also drives the fuel-scaling valve 50 to move in the same direction as does the air-scaling valve 38, the fuel passing the fuel-scaling portion, determined by the fuel-scaling valve 50 and fuel-scaling orifice 48 is naturally increased in accordance with the increase of air flow to the engine. The fuel passing the fuel-scaling valve 50 is injected as a continuous flow from the fuel injection portion 44 into the air-intake path 12. Of course, the shape of the fuel-scaling valve 50 is determined so that the air/fuel ratio at this time approaches to a target value as set forth above.

When the throttle valve 18 is opened to a constant degree, the value of the signal H/W from the sensor 32 has equal proportions of higher- and lower-portions than the setting level $R_{ef}$. Therefore, the proportion electromagnetic device 42 is kept at that condition and thus the fuel-scaling portion formed of the fuel-scaling valve 50 and fuel-scaling orifice 48 is considered to be apparently a fixed orifice. Of course, the shape of the fuel-scaling valve 50 is determined so that the air/fuel ratio approaches to a target value.

In FIG. 1, the electromagnetic device 24, valve 26, orifice 22 and correction air path 20 has a function of controlling the revolution rate of idle. In other words, the computer 72 has stored therein a target revolution rate of idle associated with the temperature of cooling water for engine, and an actual rotation rate of idle is compared with this target idle revolution rate, a control signal based on the resulting deviation therebetween being applied to the electromagnetic device 24 so as to change the amount of air flow in the correction air path 20 with the result that the actual idle rotation rate convergest to the target idle rotation rate. Thus, the actual idle rotation rate can be controlled to be a value suitable for the temperature of engine. In this case, the signals from the water temperature sensor 74 and the rotation rate sensor 76 are stored in the computer 72 and properly processed to produce a control signal.

Details of the fuel injection apparatus to which the invention is applied has been described.

The determination of the set level according to the present invention will now be described with reference to FIG. 4.

Figure 4:
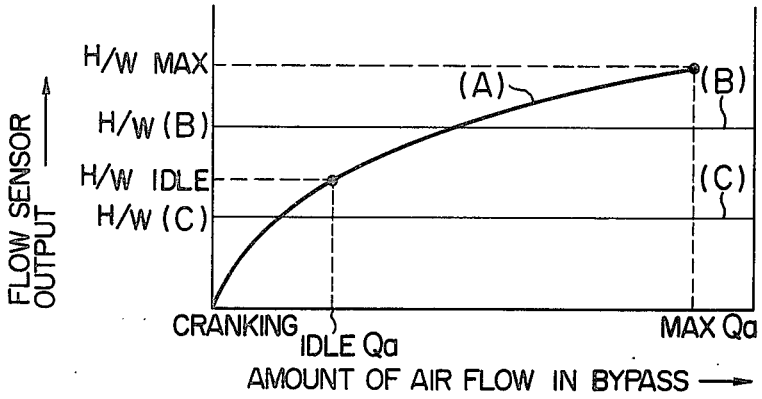
FIG. 4 is a graph showing the relation between an output signal of the air flow sensor and the set level.

Illustrated in FIG. 4 is a solid curve (A) which represents the relation between the amount of air passing through the air bypass 30 and the output of the heat-type flow sensor 32 over a range of from idling to high speed operations of the engine under a condition that the air-scaling valve 38 is fully opened, in other words, which represents a maximum output characteristic of the heat-type flow sensor 32.

As will be seen from the figure, the set level $R_{ef}$ must be below an output H/W MAX of sensor 32 corresponding to a maximum air amount MAX Qa.

If the set level $R_{ef}$ is decided to be a relatively large level as represented by, for example, a level (B) which lies between an output H/W IDLE of sensor 32 corresponding to an air amount IDLE Qa for idling operation and the output H/W MAX of sensor 32 corresponding to the maximum air amount MAX Qa, the following problem will be raised.

As described previously, the computer 72 causes the air-scaling valve 38 to be driven by the proportional electromagnetic device 42 during engine operation and controls the amount of air in the bypass 30 to a substantially constant value so that the output H/W of the heat-type flow sensor 32 converges to the set level $R_{ef}$ or $R_{ef}$ (B). Thus, when the output H/W of sensor 32 exceeds the set level $R_{ef}$(B), the computer 72 operates to decrease the degree of opening of the air-scaling valve 38, thereby decreasing the output H/W of the sensor 32. In this case, no problem arises since, for reduction of the output H/W of sensor 32, the degree of opening can be decreased until the air-scaling valve 38 is fully closed.

On the other hand, when the output H/W of the heat-type flow sensor is below the set level $R_{ef}$(B), the computer 72 operates to increase the degree of opening of the air-scaling valve 38, thereby increasing the output H/W of sensor 32. However, under the condition that the set level $R_{ef}$ corresponds to the level (B), the air-scaling valve 38 has extensively been opened to maintain the output H/W of sensor 32 at a value H/W (B) and for this reason, the amount of air passing through the bypass 30 is permitted to increase of the most by a value corresponding to [H/W MAX−H/W (B)] even when the air-scaling valve 38 has been opened to the full by an output signal from the computer 72, resulting in a problem that the output of the heat-type flow sensor 32 cannot reach the set level $R_{ef}$(B). Especially, in the event that the maximum output of sensor 32 corresponding to full opening of the air-scaling valve 38 during idling operation cannot reach the set level $R_{ef}$ (B), the feedback control for convergence of the output H/W of sensor 32 to the set level $R_{ef}$ cannot stand by itself. This problem is inevitable wherever the set level $R_{ef}$ is decided to lie between the outputs H/W IDLE and H/W MAX of the heat-type flow sensor 32.

In view of the above, according to the present invention, the set level $R_{ef}$ is determined to be a level (C) which is below the output H/W IDLE of heat-type flow sensor 32 occuring when the air-scaling valve 38 is fully opened during the idling operation.

With the set level $R_{ef}$ determined as the level (C), the degree of opening of the air-scaling valve 38 is devised by the computer 72 so as to bring the output H/W of sensor 32 to a value H/W (C). When the output H/W of the heat-type flow sensor 32 exceeds the set level $R_{ef}$ (C), the computer 72 operates to decrease the degree of opening of the air-scaling valve 38, thereby decreasing the output H/W of the sensor 32. In this case, there occurs no problem in decreasing the output H/W of the heat-type flow sensor 32 since the air-scaling valve 38 is permitted to be closed to the full. On the other hand, when the output H/W of the heat-type flow sensor is below the set level $R_{ef}$(C), the degree of opening of the air-scaling valve 38 is increased by the computer 72 to increase the output H/W of the sensor 32. At this time, thanks to the set level $R_{ef}$ determined as $R_{ef}$ (C), the amount of air passing through the bypass 30 is permitted to increase to the most by a value corresponding to [H/W MAX − H/W (C)] and the range over which the amount of air in the bypass 30 is controlled can advantageously be increased.

Especially, since the set level $R_{ef}$ (C) is below the output H/W IDLE of heat-type flow sensor 32 occurring when the air-scaling valve 38 is fully opened during the idling operation, the output H/W of the heat-type flow sensor 32 never fails to intersect the set level $R_{ef}$ (C) when its increases or decreases during the idling operation, thereby ensuring that the feedback control can stand by itself during the idling operation.

As has been described, according to the invention, the set level is made smaller than the maximum output of the air flow sensor occurring when the air-scaling valve is fully opened during the idling operation to ensure the feedback control during the idling operation.

We claim:

1. A fuel injection apparatus for internal combustion engine comprising:

an air bypass for communicating the upstream side of a Venturi portion formed in an air-intake path with the Venturi portion;

an air flow sensor provided in the middle of said air bypass;

an air-scaling valve provided in said air bypass so as to control the amount of air flow in said air bypass;

a level setting means for producing a set level value which is smaller than a maximum output value of said air flow sensor occuring when said air-scaling valve is fully opened during idling operation of the engine;

a discriminating means for comparing and discriminating the set level produced from said level setting means and an output of said air flow sensor;

a control signal generating means responsive to a discrimination signal from said discriminating means, for generating a control signal which controls said air-scaling valve so that the output of said air flow sensor converges to said set level; and a fuel control means responsive to the control signal, for controlling fuel fed from a fuel supply means.

2. A fuel injection apparatus for internal combustion engine according to claim 1 wherein the discrimination signal from said discriminating means is converted into a duty pulse by said control signal generating means.

3. A fuel injecton apparatus for internal combustion engine according to claim 2 wherein said air flow sensor comprises a heat-type flow sensor.

4. A fuel injection apparatus for internal combustion engine according to claim 3 wherein the signal of said heat-type flow sensor and the set level are produced in the form of voltages which are compared by a differential amplifier to produce the discrimination signal.

5. A fuel injection apparatus for internal combustion engine comprising:

an air-intake path connected to the upstream side of an air-intake tube meeting portion;

a Venturi portion formed in said air-intake path;

a throttle valve provided in said air-intake path on the downstream side of said Venturi portion;

an air bypass for connecting the upstream side of said Venturi portion and said Venturi portion;

an air flow meter provided in said air bypass so as to detect the amount of air flow in said air bypass;

an air-scaling valve provided in said air bypass;

a fuel path through which fuel from a fuel pump is continuously fed into said air-intake path when the internal combustion engine is operating;

a fuel-scaling valve provided in said fuel path;

a drive means for controlling the degree to which said air-scaling valve and said fuel-scaling valve are opened, so that when said air-scaling valve is displaced to decrease the amount of air flow in said air bypass, said fuel-scaling valve is displaced to increase fuel;

a level setting means for producing a set level value which is smaller than a maximum output value of said air flow meter occurring when said air-scaling valve is fully opened during idling operation of the engine;

a discriminating means for comparing and discriminating the set level produced from said level setting means and an output of said air flow meter; and a control signal generating means responsive to a discrimination signal from said discriminating means, for applying a control signal to said drive means so as to control the degree of opening of said air-scaling valve so that the output of said air flow meter converges to said set level.

* * * * *